US011667098B2

(12) United States Patent
Mousson

(10) Patent No.: US 11,667,098 B2
(45) Date of Patent: Jun. 6, 2023

(54) SYSTEM FOR PRODUCING LENGTHS OF TUBE COMPRISING HELICALLY WOUND STRIPS

(71) Applicant: IMATEC—INNOVATIVE MACHINE TECHNOLOGY S.A R.L, Ettelbruck (LU)

(72) Inventor: Pierre Jacques Mousson, Spa (BE)

(73) Assignee: IMATEC—INNOVATIVE MACHINE TECHNOLOGY S.A R.L, Ettelbruck (LU)

( * ) Notice: Subject to any disclaimer, the term of this patent is extended or adjusted under 35 U.S.C. 154(b) by 0 days.

(21) Appl. No.: 17/292,977

(22) PCT Filed: Nov. 12, 2019

(86) PCT No.: PCT/EP2019/080936

§ 371 (c)(1),
(2) Date: May 11, 2021

(87) PCT Pub. No.: WO2020/099360

PCT Pub. Date: May 22, 2020

(65) Prior Publication Data

US 2021/0402728 A1 Dec. 30, 2021

(30) Foreign Application Priority Data

Nov. 12, 2018 (NL) ..... 2021981

(51) Int. Cl.
*B31C 11/04* (2006.01)
*B31C 3/00* (2006.01)

(52) U.S. Cl.
CPC ..... *B31C 11/04* (2013.01); *B31C 3/00* (2013.01)

(58) Field of Classification Search
CPC ..... B31C 11/04; B31C 3/00; B31D 5/0091; B31D 5/0095; A47G 21/18
See application file for complete search history.

(56) References Cited

U.S. PATENT DOCUMENTS 2,233,423 A 3/1941 Magill
3,581,744 A * 6/1971 Voss ..... A61F 13/2085 604/14
5,059,164 A * 10/1991 Van Davelaar ..... B29C 65/52 493/27
6,190,485 B1 2/2001 Cahill et al.
(Continued)

FOREIGN PATENT DOCUMENTS

DE 2724899 A1 12/1978
GB 1587475 A 4/1981

OTHER PUBLICATIONS

Netherlands Search Report and Written Opinion dated Apr. 2, 2019, corresponding to Application No. 2021775.
(Continued)

*Primary Examiner* — Chelsea E Stinson
(74) *Attorney, Agent, or Firm* — Patterson + Sheridan, LLP

(57) ABSTRACT

A system comprising a mandrel, a winding device for helically winding strips around the mandrel to form a base tube moving away from the mandrel at a tube speed, a strip suppling device for supplying the strips to the winding device, and a cutting device for cutting the base tube at a predetermined length to form the lengths of tube while the base tube is moving in a tube direction at the tube speed, and a method.

25 Claims, 9 Drawing Sheets

(56) References Cited

U.S. PATENT DOCUMENTS

Figure 1A:
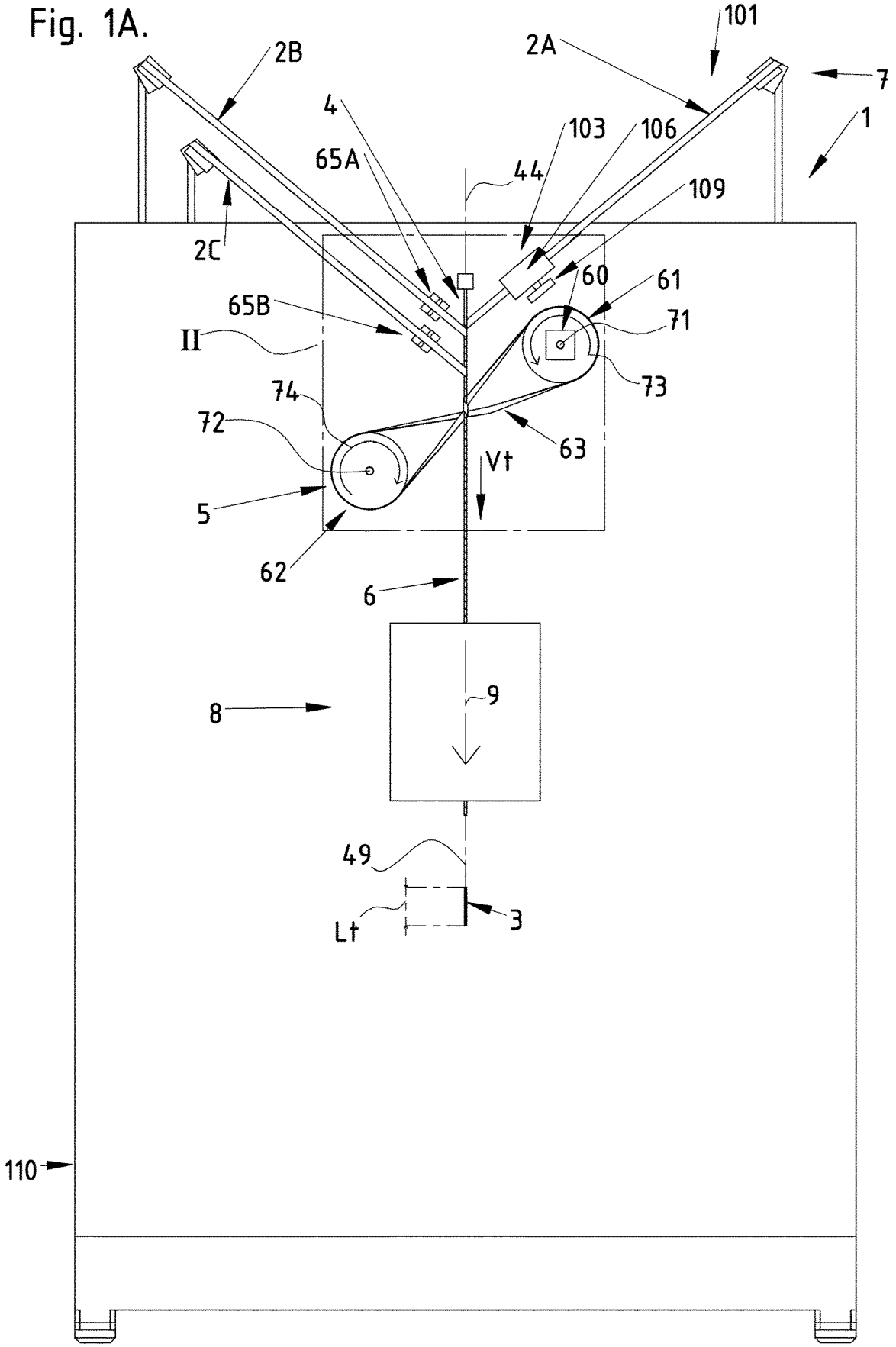

| | | | | |
|---|---|---|---|---|
| 6,350,500 | B1 * | 2/2002 | Drummond | B65D 3/22 229/203 |
| 2004/0265526 | A1 * | 12/2004 | Jones | B31C 3/00 428/36.9 |
| 2007/0032361 | A1 * | 2/2007 | Venuti | B31C 3/00 493/276 |

OTHER PUBLICATIONS

International Search Report and Written Opinion dated Apr. 8, 2020, corresponding to Application No. PCT/NL2019/050667.

* cited by examiner

SYSTEM FOR PRODUCING LENGTHS OF TUBE COMPRISING HELICALLY WOUND STRIPS

FIELD OF THE INVENTION

The invention relates to a system for producing lengths of tube, such as drinking straws, comprising helically wound strips. The system comprises a mandrel, a winding device for helically winding strips around the mandrel to form a base tube moving away from the mandrel at a tube speed, a strip suppling device for supplying the strips to the winding device, a lubrication device to provide a layer of lubrication a strip before said strip is wound around the mandrel, and a cutting device for cutting the base tube at a predetermined length to form the lengths of tube while the base tube is moving in a tube direction at the tube speed.

BACKGROUND OF THE INVENTION

The invention is based on the inside that the known system tends so have issues relating the helical winding of the strips around the mandrel.

SUMMARY OF THE INVENTION

The invention has the objective to provide an improved (or at least alternative) system for producing lengths of tube, such as drinking straws, comprising helically wound strips. According to a further aspect, the invention has the objective to provide a system in which the helical winding of the strips around the mandrel is performed smoother and/or more accurate.

For this reason, the system comprises a mandrel, a winding device for helically winding strips around the mandrel to form a base tube moving away from the mandrel at a tube speed, wherein a selection of at least one of the strips during the winding is placed with a contact side thereof in direct contact with the mandrel, a strip supplying device for supplying the strips to the winding device, a cutting device for cutting the base tube at a predetermined length to form the lengths of tube while the base tube is moving in a tube direction at the tube speed, wherein the system comprises a lubrication device along which the at least one strip of the selection is moved to apply a layer of lubrication material on the contact side of the at least one strip of the selection before said at least one strip of the selection is wound around the mandrel, the lubrication device comprises at least one lubrication member, each lubrication member has a cylindrical outer surface made from the lubrication material and defining a cylinder axis, which cylindrical outer surface is in contact with the contact side of one or more of the at least one strip of the selection, each lubrication member is rotatable about the cylinder axis thereof, and the lubrication device comprises at least one lubrication drive to rotate the at least one lubrication member about the cylinder axis thereof.

In this system, the helical winding of the strips around the mandrel is performed relatively smoother and/or more accurate.

In an embodiment of the system, the lubrication device comprises a lubrication controller configured to control the rotation direction and/or the rotational speed of the at least one lubrication member to control a thickness of the layer of lubrication material applied to the contact side of the at least one strip of the selection.

In an embodiment of the system, the lubrication controller is configured to adjust the thickness of the layer of lubrication material applied to the contact side of the at least one strip of the selection by adjusting the rotation direction and/or the rotational speed of the at least one lubrication member.

In an embodiment of the system, the lubrication controller is configured to control a speed difference between the contact side of the at least one strip of the selection and the cylindrical outer surface of the at least one lubrication member by adjusting the rotation direction and/or the rotational speed of the at least one lubrication member.

In an embodiment of the system, the lubrication controller is configured to maintain the speed difference between the contact side of the at least one strip of the selection and the cylindrical outer surface of the at least one lubrication member at a predetermined speed value in order to maintain the thickness of the applied layer of lubrication material at a predetermined thickness value.

In an embodiment of the system, the lubrication controller is configured to increase the speed difference between the contact side of the at least one strip of the selection and the cylindrical outer surface of the at least one lubrication member in order to increase the thickness of the applied layer of lubrication material.

In an embodiment of the system, the lubrication controller is configured to decrease the speed difference between the contact side of the at least one strip of the selection and the cylindrical outer surface of the at least one lubrication member in order to decrease the thickness of the applied layer of lubrication material.

In an embodiment of the system, the lubrication device comprises at least one member surface sensor to measure a member surface characteristic, such as a member surface speed or a member surface radius, of the cylindrical outer surface of the at least one lubrication member and at least one member communication connection connecting the lubrication controller with the at least one member surface sensor, and the lubrication controller is configured to control the rotation direction and/or the rotational speed of the lubrication member on basis of measurements from the at least one member surface sensor.

In an embodiment of the system, the lubrication device comprises at least one strip surface sensor to measure a strip surface speed of the contact side of the at least one strip of the selection and at least one strip communication connection connecting the lubrication controller with the at least one strip surface sensor, and the lubrication controller is configured to control the rotation direction and/or the rotational speed of the lubrication member on basis of measurements from the at least one strip surface sensor.

In an embodiment of the system, the lubrication controller is connected with the winding device, more specifically with a winding drive of the winding device, via a winding communication connection, and the lubrication controller is configured to control a winding speed with which the at least one strip of the selection is wound around the mandrel on basis of measurements from the at least one strip surface sensor.

In an embodiment of the system, the lubrication device comprises at least one strip surface sensor to measure a strip surface speed of the contact side of the at least one strip of the selection and at least one strip communication connection connecting the lubrication controller with the at least one strip surface sensor, the lubrication controller is connected with the winding device, more specifically with a winding drive of the winding device, via a winding communication connection, and the lubrication controller is configured to control a winding speed with which the at least one strip of the selection is wound around the mandrel on basis of measurements from the at least one strip surface sensor.

In an embodiment of the system, the lubrication controller is configured to control the rotation direction and/or the rotational speed of the lubrication member on basis of measurements from the at least one strip surface sensor.

In an embodiment of the system, the lubrication controller is configured to rotate the cylindrical outer surface of the at least one lubrication member in an opposite direction as the contact side of the at least one strip of the selection being in contact with the cylindrical outer surface in order to control the thickness of the layer of lubrication material applied to said contact side.

In an embodiment of the system, the lubrication controller is configured to increase the rotational speed of the cylindrical outer surface of the at least one lubrication member in an opposite direction as the contact side of the at least one strip of the selection being in contact with the cylindrical outer surface in order to increase the thickness of the layer of lubrication material applied to said contact side.

In an embodiment of the system, the lubrication controller is configured to rotate the cylindrical outer surface of the at least one lubrication member in a same direction as the contact side of the at least one strip of the selectin being in contact with the cylindrical outer surface in order to control the thickness of the layer of lubrication material applied to said contact side.

In an embodiment of the system, the lubrication controller is configured to increase the rotational speed of the cylindrical outer surface of the at least one lubrication member in a same direction as the contact side of the at least one strip of the selection being in contact with the cylindrical outer surface in order to decrease the thickness of the layer of lubrication material applied to said contact side. This relates to the situation in which the cylindrical outer surface of the at least one lubrication member is moving at a lower speed than the contact side of the at least one strip of the selection.

In an embodiment of the system, the lubrication controller is configured to increase the rotational speed of the cylindrical outer surface of the at least one lubrication member in a same direction as the contact side of the at least one strip of the selection being in contact with the cylindrical outer surface in order to increase the thickness of the layer of lubrication material applied to said contact side. This relates to the situation in which the cylindrical outer surface of the at least one lubrication member is moving at a higher speed than the contact side of the at least one strip of the selection.

In an embodiment of the system, the strip supplying device is configured to supply paper strips and the winding system is configured to helically wind the paper strips around the mandrel.

In an embodiment of the system, the strip supplying device is configured to supply only paper strips.

In an embodiment of the system, the lubrication material is a solid material.

In an embodiment of the system, the lubrication material is a wax, such as a paraffin wax.

In an embodiment of the system, the lubrication member has a first strip guide located at a first end of the cylindrical outer surface and a second strip guide located at a second end of the cylindrical outer surface, and the first strip guide and the second strip guide extend radially with respect to the cylinder axis and beyond the cylindrical outer surface.

In an embodiment of the system, wherein the lubrication controller is connected with the lubrication drive via a lubrication communication connection.

It will be clear that any combination of the features of any number of the above defined embodiments of the system can be made.

The invention further relates to a method for producing lengths of tube, such as drinking straws, with a system according to the invention, said method comprising supplying strips with the strip supplying device to the winding device and helically winding said strips around the mandrel to form a base tube moving away from the mandrel at a tube speed, wherein a selection of at least one of the strips during the winding is placed with a contact side thereof in direct contact with the mandrel, cutting the base tube at a predetermined length with the cutting device while the base tube is moving in a tube direction at the tube speed, and moving the at least one strip of the selection along the lubrication device to apply a layer of lubrication material on the contact side of the at least one strip of the selection before said at least one strip of the selection is wound around the mandrel.

In an embodiment of the method, the method comprises using the lubrication controller to control the rotation direction and/or the rotational speed of the at least one lubrication member driven by the at least one lubrication drive.

In an embodiment of the method, the method comprises using the lubrication controller to adjust a thickness of the layer of lubrication material applied to the contact side of the at least one strip of the selection by adjusting the rotation direction and/or the rotational speed of the at least one lubrication member.

BRIEF DESCRIPTION OF THE INVENTION

Figure 1B:
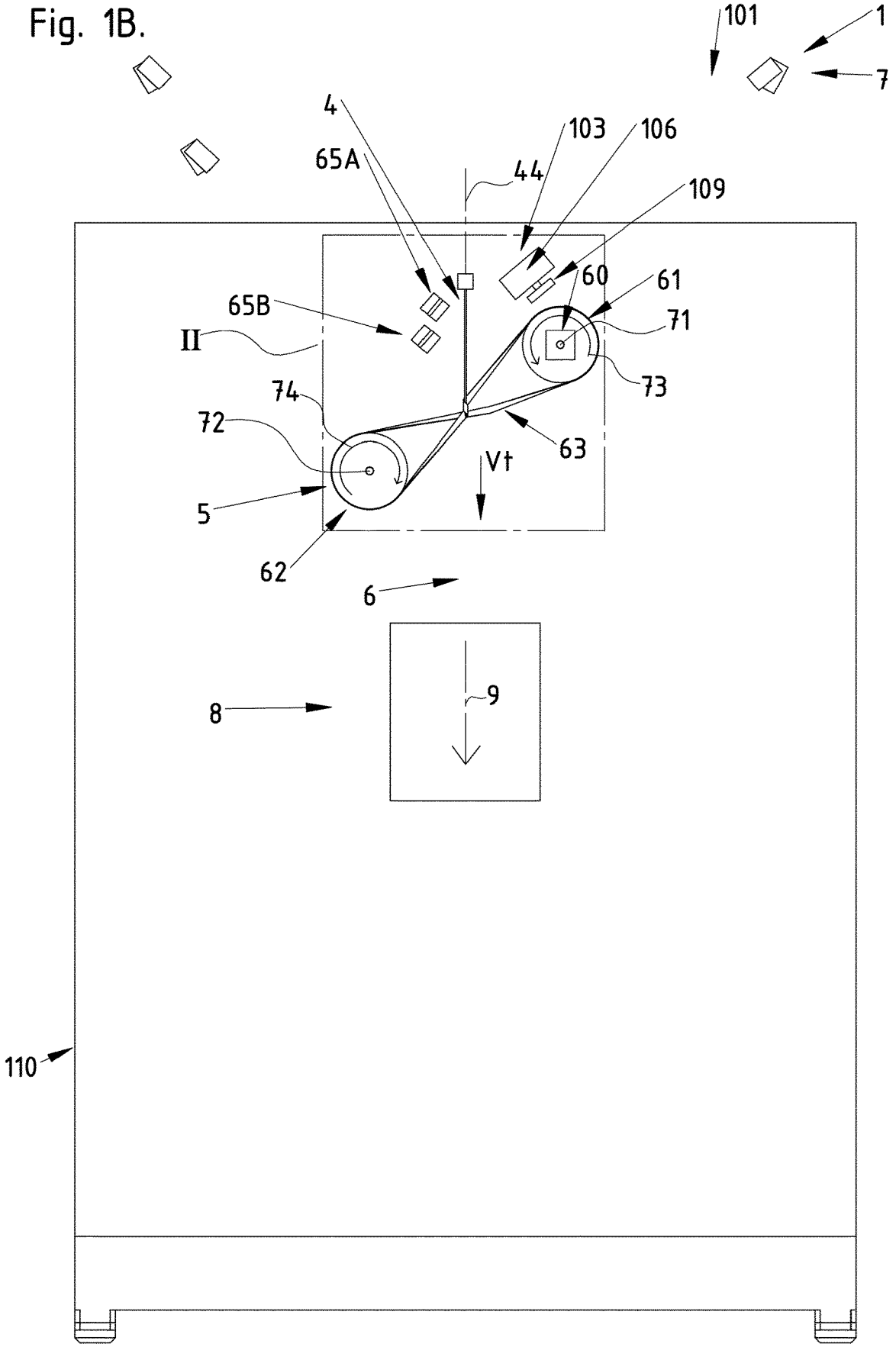
Figure 1C:
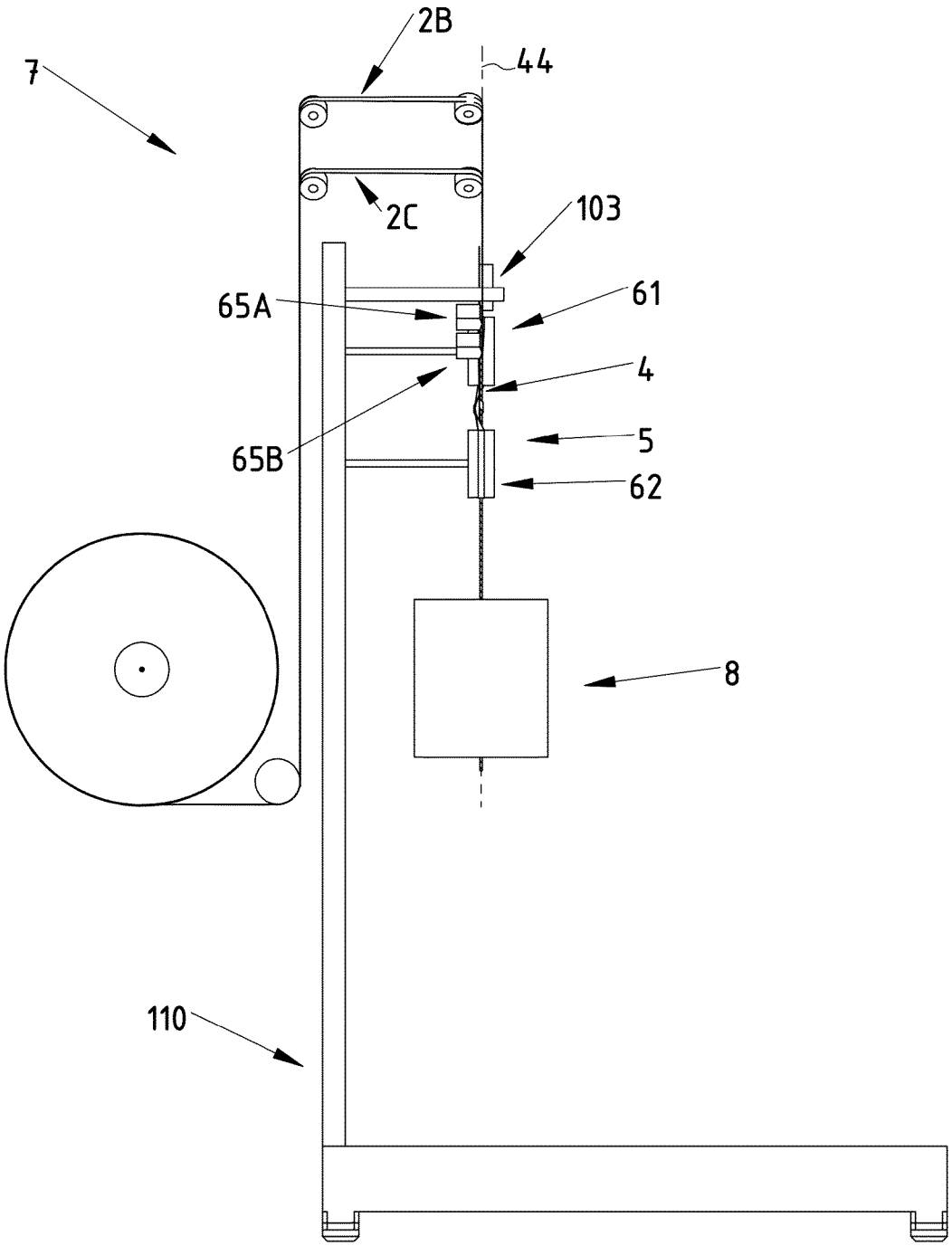
Figure 1D:
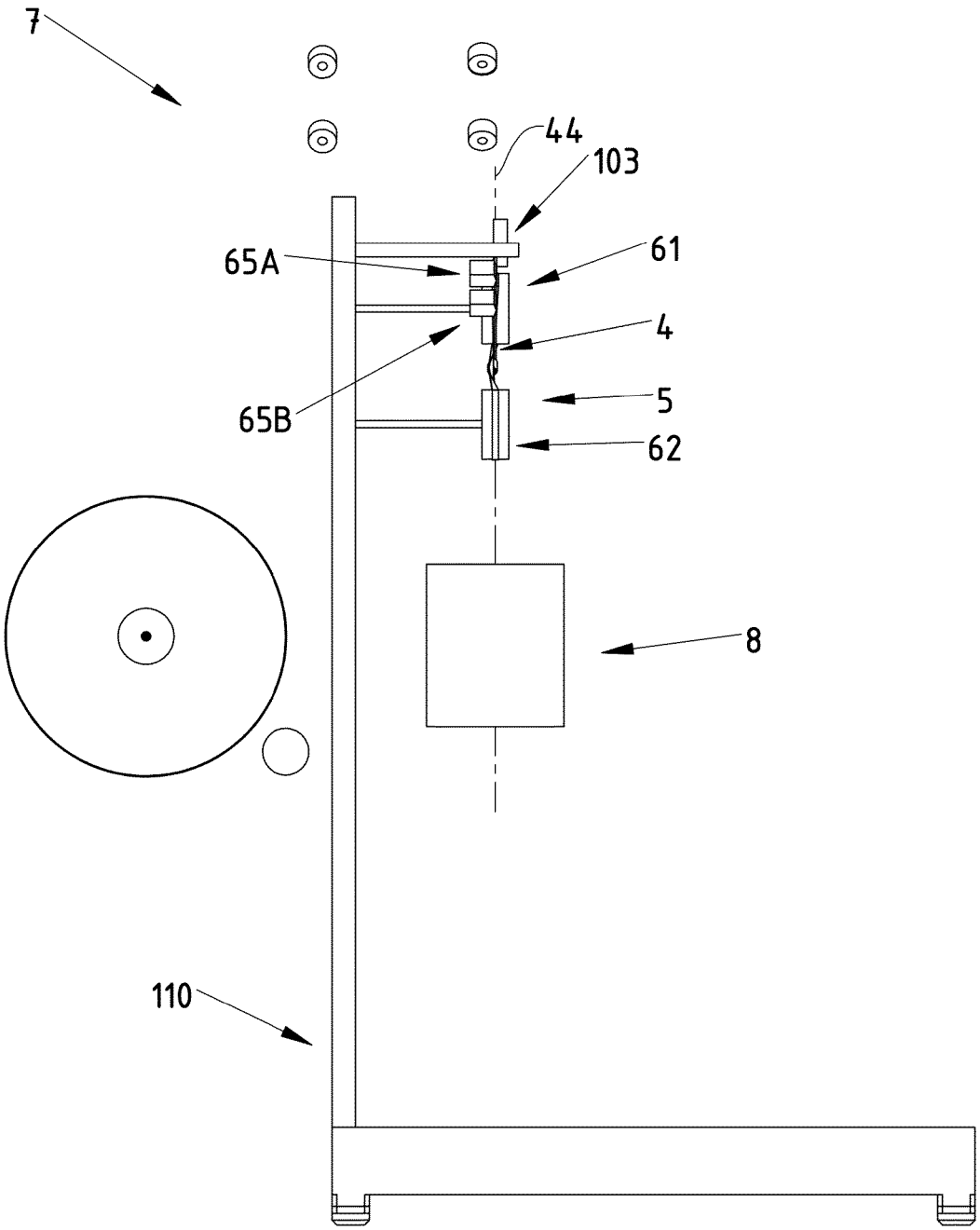
Figure 2:
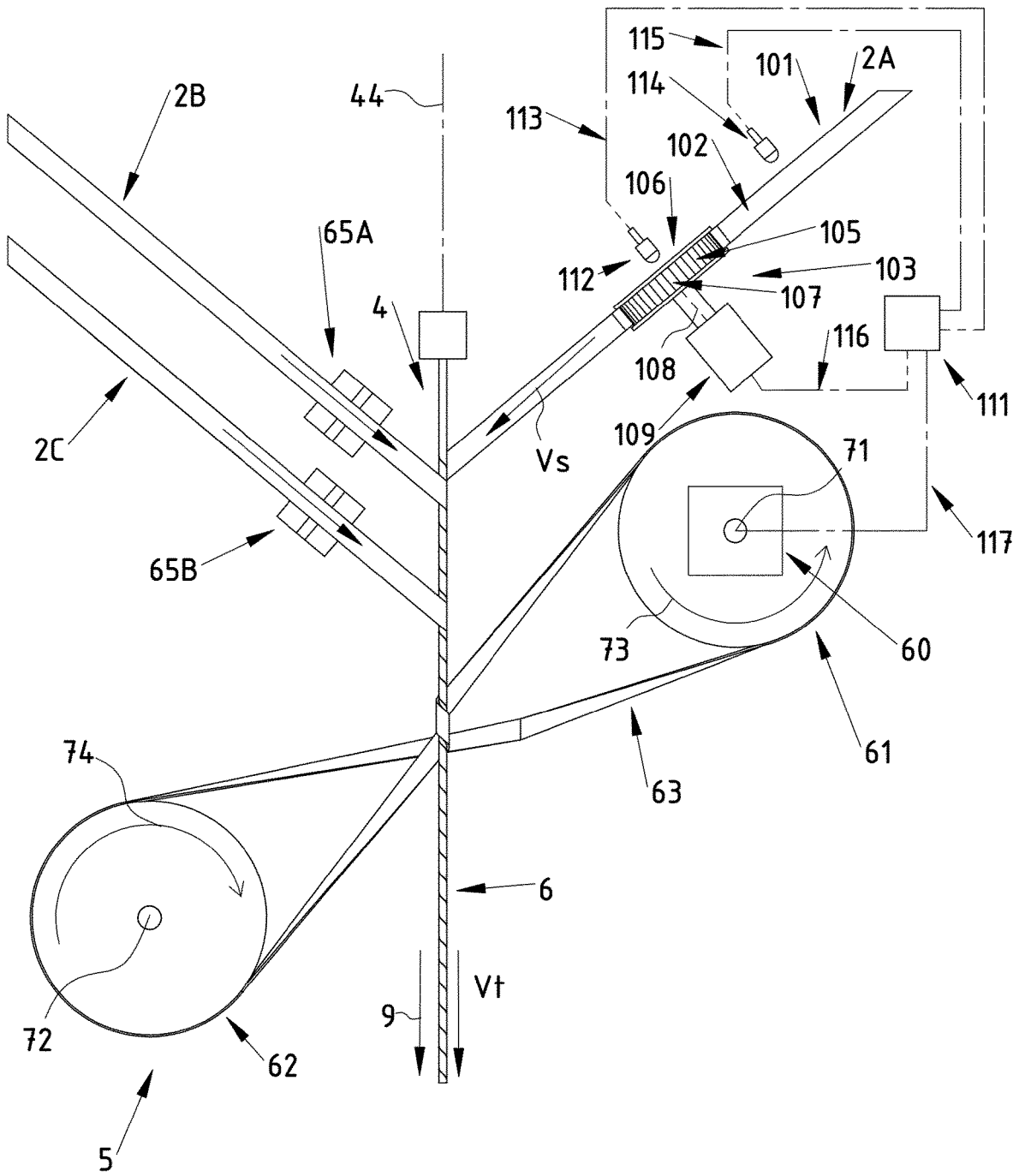
Figure 3A:
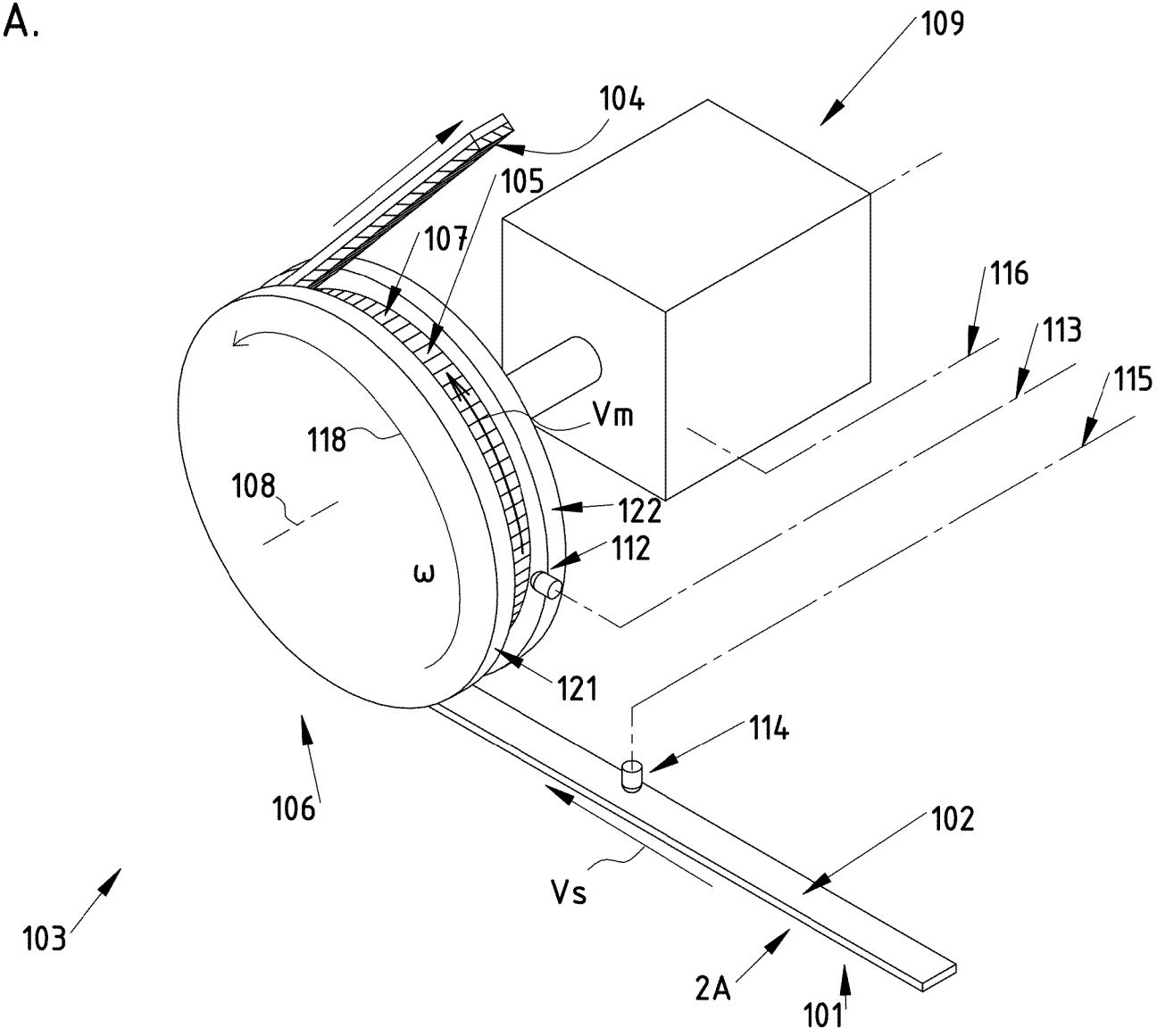
Figure 3B:
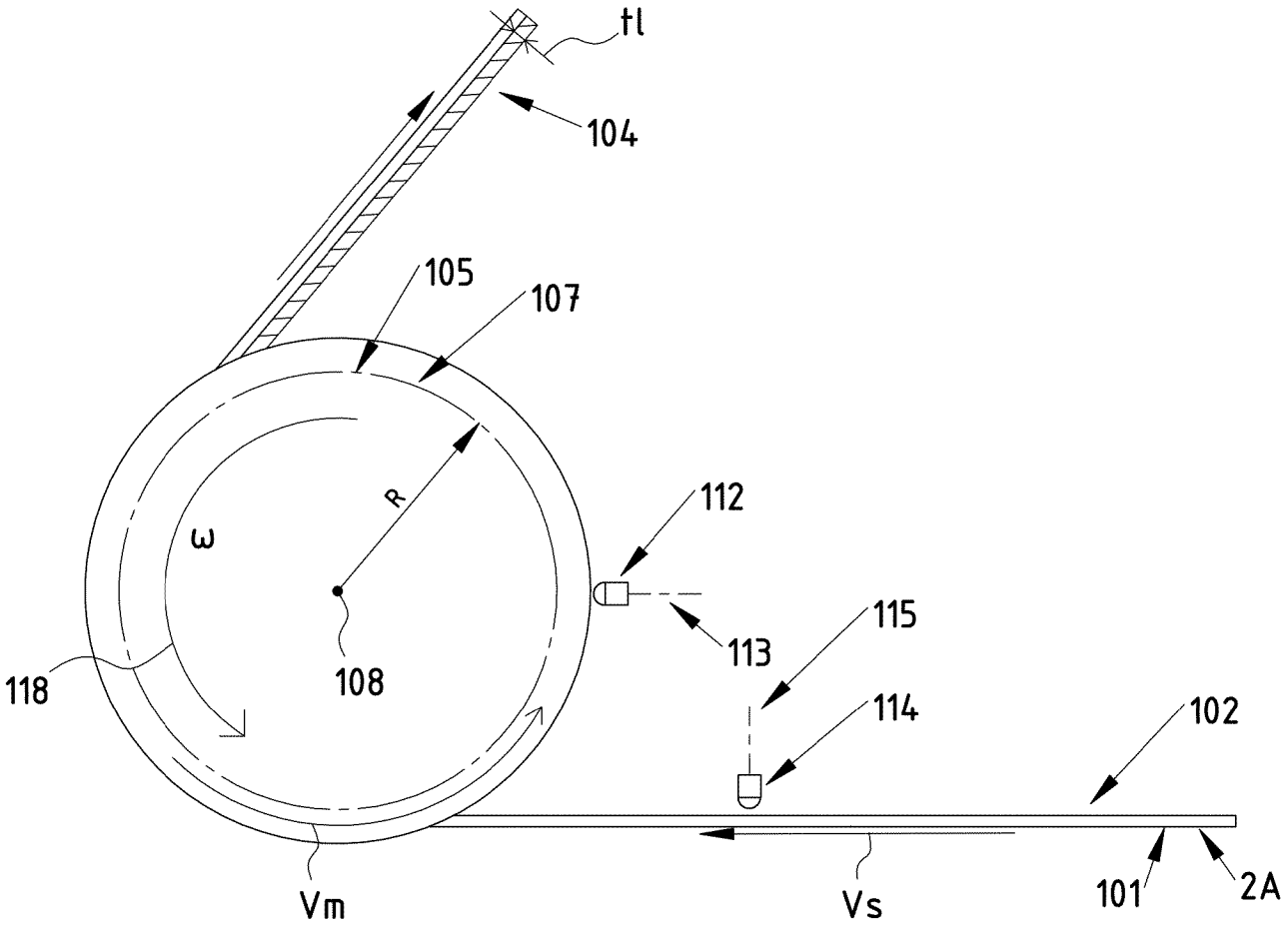
Figure 3C:
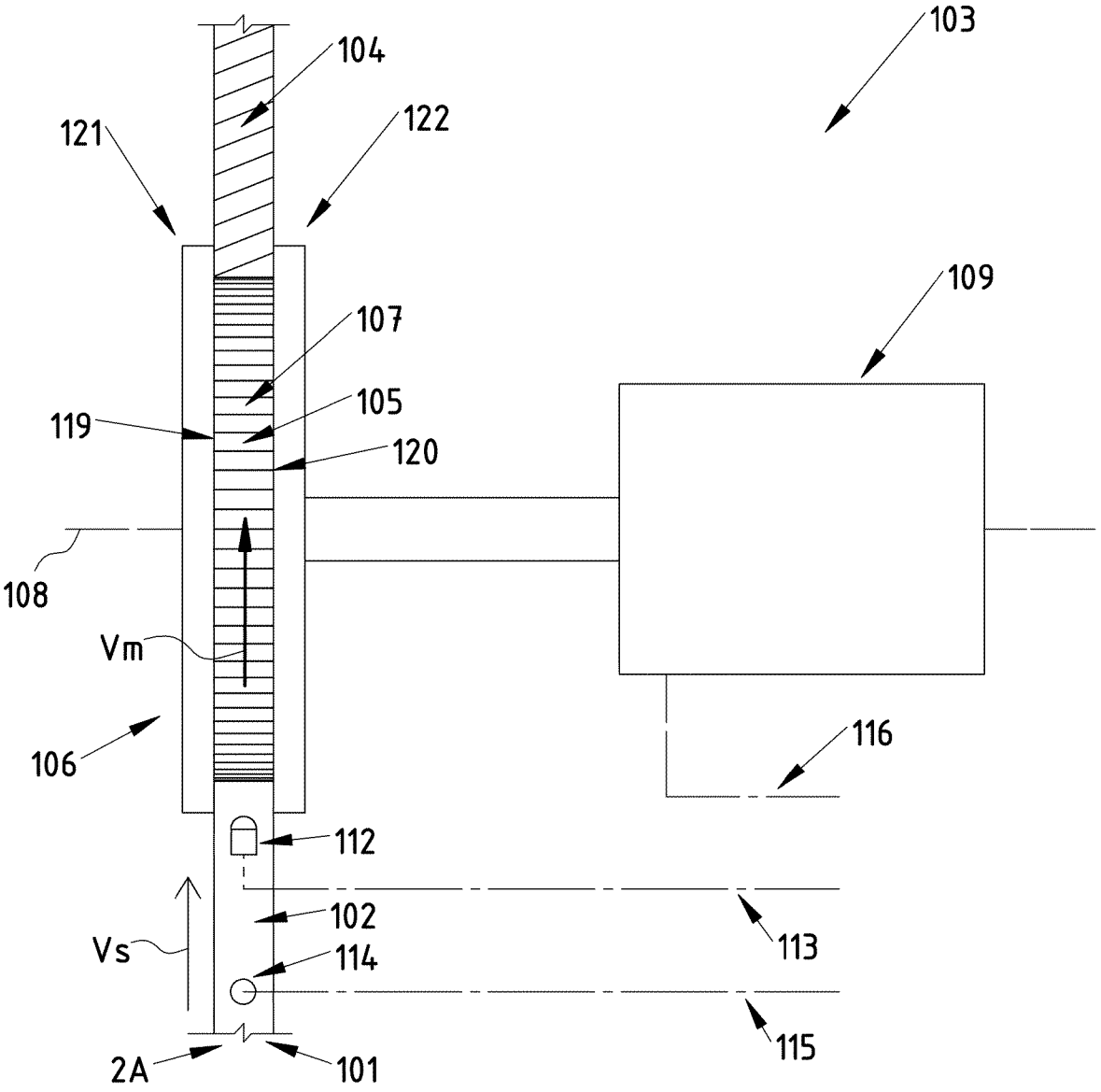
Figure 4:
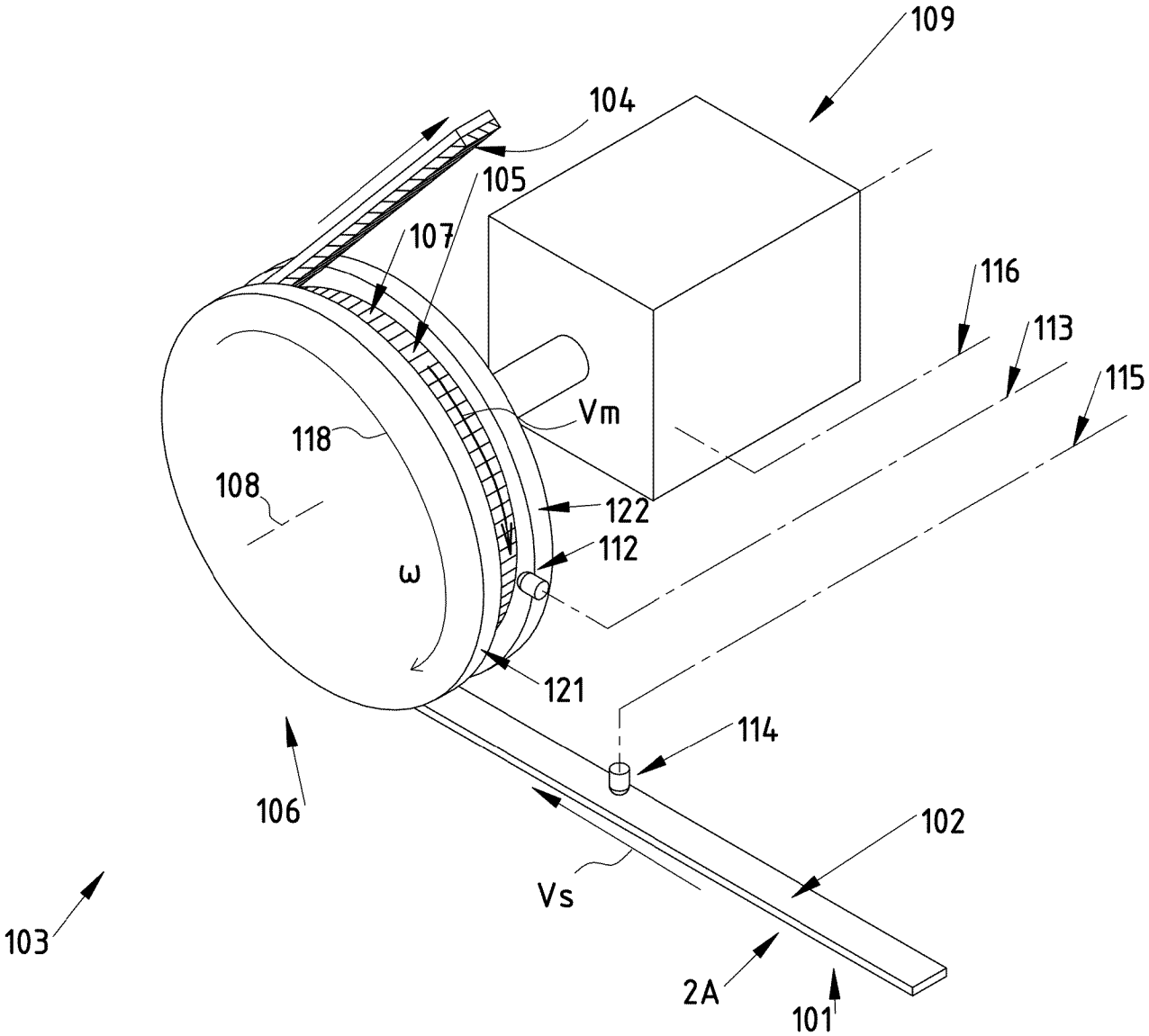

Embodiments of the system and method according to the invention will be described by way of example only, with reference to the accompanied schematic drawings in which corresponding reference symbols indicate corresponding parts, and in which;

FIG. 1A schematically shows a front view of an embodiment of the system according to the invention, FIG. 1B schematically shows the front view of FIG. 1A without the strips and the base tube, FIG. 1C schematically shows a side view of the system of FIG. 1A, FIG. 1D schematically shows the side view of FIG. 1C without the strips and the base tube, FIG. 2 schematically shows an enlarged view of part II of FIG. 1A, FIG. 3A schematically shows a view in perspective of the lubrication device of FIG. 1A, FIG. 3B schematically shows a side view of the lubrication device of FIG. 3A, FIG. 3C schematically shows a top view of the lubrication device of FIG. 3A, and FIG. 4 schematically shows a view in perspective of the lubrication device of FIG. 3A rotating in the opposite direction.

DETAILED DESCRIPTION OF THE INVENTION

The FIGS. 1A-D show views of an embodiment of the system 1 according to the invention. Said system 1 is configured to perform the method according to the invention.

The system 1 comprises a mandrel 4, a winding device 5 for helically winding strips 2 around the mandrel 4 to form a base tube 6 moving away from the mandrel 4 at a tube speed $v_t$ (meter/second), a strip suppling device 7 for supplying the strips 2 to the winding device 5, and a cutting device 8 for cutting the base tube 6 at a predetermined length $l_t$ to form the lengths of tube 3 while the base tube 6 is moving in a tube direction 9 at the tube speed $v_t$. The system 1 comprises a support frame 110.

The supplying device 7 supplies a first strip 2A, a second strip 2B and a third strip 2C. A selection 101 of the strips 2 is during the winding placed with a contact side 102 thereof in direct contact with the mandrel 4. In this situation, the selection 101 of strips 2 consists of the first strip 2A. In other words, the first strip 2A forms the selection 101 of at least one strip 2 which during the winding is placed with a contact side 102 thereof in direct contact with the mandrel 4. In other examples of an embodiment of the system 1, the selection 101 of strips 2 may consist of a different number, such as two, three or four strips 2.

The system 1 comprises a lubrication device 103 along which the first strip 2A is moved to apply a layer 104 of lubrication material 105 on the contact side 102 of the first strip 2A before the first strip 2A is wound around the mandrel 4. The layer 104 of lubrication material 105 functions as a lubrication between the mandrel 4 and the first strip 2A.

The lubrication device 103 comprises a lubrication member 106. In other examples of an embodiment of the system 1, such as systems wherein the at least one strip 2 of the selection 101 contains multiple strips 2, the system 1 comprises multiple lubrication members 106. In yet other examples of an embodiment of the system 1, such as systems wherein the at least one strip 2 of the selection 101 contains multiple strips 2, the system 1 comprises one or more large lubrication members 106 being in contact with multiple strips 2 from the selection 101.

The lubrication member 106 has a cylindrical outer surface 107 made from the lubrication material 105 and defining a cylinder axis 108, which cylindrical outer surface 107 is in contact with the contact side 102 of the first strip 2A. The lubrication member 106 is rotatable about the cylinder axis 108.

The lubrication device 103 comprises a lubrication drive 109 to rotate the lubrication member 106 about the cylinder axis 108. In other examples of an embodiment of the system, such as systems comprising multiple lubrication members 106, the system comprises multiple lubrication drives 109.

Due to the configuration of the lubrication device 103, the helical winding of the strips 2 around the mandrel 4 is performed smoother and/or more accurate.

During the helically winding, the second strip 2B and the third strip 2C are not in direct contact with the mandrel 4. The second strip 2B is moved along a first adhesive unit 65A to apply a layer of adhesive to the second strip 2B so that it will adhere to the first strip 2. The third strip 2C is moved along a second adhesive unit 65B to apply a layer of adhesive to the third strip 2C so that it will adhere to the second strip 2B. This way the base tube 6 is formed.

The second strip 2B and the third strip 2C are not in contact with the lubrication device 103. The second strip 2B and the third strip 2C are not part of the selection 101 of strips 2. In other examples of an embodiment of the system 1, the system may have a different number (such as 1, 3, 4, or 5) of strips 2 not part of the selection 101.

The first, second and third strips 2A-C are paper strips 2. The strip supplying device 7 is configured to supply only paper strips 2 and the winding system 1 is configured to helically wind the paper strips 2 around the mandrel 4. In other examples of an embodiment of the system 1, the strip supplying device 7 may be configured to (also) supply strips 2 made from a different material, such as one or more plastics.

The mandrel 4 has an elongate form defining a longitudinal mandrel axis 44 extending in line with the tube direction 9.

The winding device 5 comprises a first winding roller 61 and a second winding roller 62 located at opposite sides of the mandrel 4. The first winding roller 61 is rotatable about a first roller axis 71 and the second winding roller 62 is rotatable about a second roller axis 72. A winding belt 63 extends around the first winding roller 61 and the second winding roller 62. The winding belt 63 is wound around the mandrel 4. The winding device 5 comprises a winding drive 60 operatively coupled to the first winding roller 61 for rotation about the first roller axis 71 as shown by the first rotation arrow 73. This will cause a movement of the winding belt 63 around the mandrel 4 and around the second roller axis 72 of the second winding roller 62 as indicated by the second rotation arrow 74. The winding belt 63 will helically wind the strips 2 around the mandrel 4 to form the base tube 6 moving along and away from the mandrel 4 at the tube speed $v_t$. The base tube 6 comprises a longitudinal tube axis 49. Due to the winding movement of winding belt 63, the base tube 6 rotates around its longitudinal tube axis 49.

FIG. 2 shows an enlarged view of part II of FIG. 1A in order to show more details of the lubrication device 103. The lubrication device 103 comprises a lubrication controller 111 configured to control the rotation direction 118 and the rotational speed ω (cycles/minute) of the lubrication member 106 to control a thickness $t_l$ (mm) of the layer 104 of lubrication material 105 applied to the contact side 102 of the first strip 2A (see also FIG. 3C). By controlling the rotational speed ω of the lubrication member 106, a member surface speed $v_m$ (meter/second) of the cylindrical outer surface 107 of the lubrication member 106 can be controlled. The lubrication controller 111 is connected with the lubrication drive 109 via a lubrication communication connection 116.

In other examples of an embodiment of the system, the lubrication controller 111 is configured to control only the rotation direction 118 or the rotational speed ω of the lubrication member 106.

FIG. 3A shows a view in perspective of the lubrication device 103 of FIG. 1A. FIG. 3B shows a side view of the lubrication device 103 of FIG. 3A. In FIG. 3A-C, the lubrication member 106 is moving in the opposite direction as the first strip 2A. FIG. 3C shows a top view of the lubrication device 103 of FIG. 3A. FIG. 4 shows the situation wherein the lubrication member 106 of FIG. 3A is rotated in the opposite direction. In FIG. 4, the lubrication member 106 is moving in the same direction as the first strip 2A.

The lubrication device 103 is capable of operating in different ways. This will be explained below.

The lubrication controller 111 is configured to adjust the thickness $t_l$ of the layer 104 of lubrication material 105 applied to the contact side 102 of the first strip 2A by adjusting the rotation direction 118 and/or the rotational speed ω of the lubrication member 106.

The lubrication controller 111 is configured to control a speed difference between the contact side 102 of the first strip 2A and the cylindrical outer surface 107 of the lubrication member 106 by adjusting the rotation direction 118 and/or the rotational speed ω of the lubrication member 106. Said speed difference may be calculated as the difference between the strip surface speed $v_s$ and the member surface speed $v_m$.

The lubrication controller 111 is configured to maintain the speed difference between the contact side 102 of the first strip 2A and the cylindrical outer surface 107 of the lubrication member 106 at a predetermined speed value in order to maintain the thickness $t_l$ of the applied layer 104 of lubrication material 105 at a predetermined thickness value.

The lubrication controller 111 is configured to increase the speed difference between the contact side 102 of the first strip 2A and the cylindrical outer surface 107 of the lubrication member 106 in order to increase the thickness $t_l$ of the applied layer 104 of lubrication material 105.

The lubrication controller 111 is configured to decrease the speed difference between the contact side 102 of the first strip 2A and the cylindrical outer surface 107 of the lubrication member 106 in order to decrease the thickness $t_l$ of the applied layer 104 of lubrication material 105.

The lubrication device 103 comprises a member surface sensor 112 to measure a member surface characteristic, such as a member surface speed $v_m$ or a member surface radius R, of the cylindrical outer surface 107 of the lubrication member 106 and a member communication connection 113 connecting the lubrication controller 111 with the member surface sensor 112. The lubrication controller 111 is configured to control the rotation direction 118 and/or the rotational speed ω of the lubrication member 106 on basis of measurements from the member surface sensor 112.

The lubrication device 103 comprises a strip surface sensor 114 to measure a strip surface speed $v_s$ of the contact side 102 of the first strip 2A and a strip communication connection 115 connecting the lubrication controller 111 with the strip surface sensor 114. The lubrication controller 111 is configured to control the rotation direction 118 and/or the rotational speed ω of the lubrication member 106 on basis of measurements from the strip surface sensor 114.

The lubrication controller 111 is connected with the winding device 5, more specifically with the winding drive 60, via a winding communication connection 117. The lubrication controller 111 is configured to control a winding speed with which the first strip 2A is wound around the mandrel 4 on basis of measurements from the strip surface sensor 114.

The lubrication device 103 comprises a strip surface sensor 114 to measure a strip surface speed $v_s$ of the contact side 102 of the first strip 2A and a strip communication connection 115 connecting the lubrication controller 111 with the strip surface sensor 114. The lubrication controller 111 is connected with the winding device 5, more specifically with the winding drive 60, via a winding communication connection 117. The lubrication controller 111 is configured to control a winding speed with which the first strip 2A is wound around the mandrel 4 on basis of measurements from the strip surface sensor 114.

The lubrication controller 111 is configured to control the rotation direction 118 and/or the rotational speed ω of the lubrication member 106 on basis of measurements from the strip surface sensor 114.

The lubrication controller 111 is configured to rotate the cylindrical outer surface 107 of the lubrication member 106 in an opposite direction as the contact side 102 of the first strip 2A being in contact with the cylindrical outer surface 107 in order to control the thickness $t_l$ of the layer 104 of lubrication material 105 applied to said contact side 102.

The lubrication controller 111 is configured to increase the rotational speed ω of the cylindrical outer surface 107 of the lubrication member 106 in an opposite direction as the contact side 102 of the first strip 2A being in contact with the cylindrical outer surface 107 in order to increase the thickness $t_l$ of the layer 104 of lubrication material 105 applied to said contact side 102.

The lubrication controller 111 is configured to rotate the cylindrical outer surface 107 of the lubrication member 106 in a same direction as the contact side 102 of the first strip 2A being in contact with the cylindrical outer surface 107 in order to control the thickness $t_l$ of the layer 104 of lubrication material 105 applied to said contact side 102.

The lubrication controller 111 is configured to increase the rotational speed ω of the cylindrical outer surface 107 of the lubrication member 106 in a same direction as the contact side 102 of the first strip 2A being in contact with the cylindrical outer surface 107 in order to decrease the thickness $t_l$ of the layer 104 of lubrication material 105 applied to said contact side 102.

The lubrication material 105 is a solid material. The lubrication material 105 is a wax, such as a paraffin wax.

The lubrication member 106 has a first strip guide 121 located at a first end 119 of the cylindrical outer surface 107 and a second strip guide 122 located at a second end 120 of the cylindrical outer surface 107. The first strip guide 121 and the second strip guide 122 extend radially with respect to the cylinder axis 108 and beyond the cylindrical outer surface 107.

As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. Further, the terms and phrases used herein are not intended to be limiting, but rather, to provide an understandable description of the invention.

The terms "a" or "an", as used herein, are defined as one or more than one. The term plurality, as used herein, is defined as two or more than two. The term another, as used herein, is defined as at least a second or more. The terms including and/or having, as used herein, are defined as comprising (i.e., open language, not excluding other elements or steps). Any reference signs in the claims should not be construed as limiting the scope of the claims or the invention.

It will be apparent to those skilled in the art that various modifications can be made to the system and method shown in the accompanied schematic drawings without departing from the scope as defined in the claims.

The invention claimed is:

1. A system for producing lengths of tube, such as drinking straws, from helically wound strips, said system comprising:

a mandrel, a winding device for helically winding strips around the mandrel to form a base tube moving away from the mandrel at a tube speed, wherein a selection of at least one of the strips during the winding is placed with a contact side thereof in direct contact with the mandrel, a strip supplying device for supplying the strips to the winding device, a cutting device for cutting the base tube at a predetermined length to form the lengths of tube while the base tube is moving in a tube direction at the tube speed, wherein:

the system comprises a lubrication device along which the at least one strip of the selection is moved to apply a layer of lubrication material on the contact side of the at least one strip of the selection before said at least one strip of the selection is wound around the mandrel, the lubrication device comprises at least one lubrication member, each lubrication member has a cylindrical outer surface made from the lubrication material and defining a cylinder axis, which cylindrical outer surface is in contact with the contact side of one or more of the at least one strip of the selection, each lubrication member is rotatable about the cylinder axis thereof, and the lubrication device comprises at least one lubrication drive to rotate the at east one lubrication member about the cylinder axis thereof.

2. The system according to claim 1, wherein the lubrication device comprises a lubrication controller configured to control the rotation direction and/or the rotational speed of the at least one lubrication member to control a thickness of the layer of lubrication material applied to the contact side of the at least one strip of the selection.

3. The system according to claim 2, wherein the lubrication controller is configured to adjust the thickness of the layer of lubrication material applied to the contact side of the at least one strip of the selection by adjusting the rotation direction and/or the rotational speed of the at least one lubrication member.

4. The system according to claim 2, wherein the lubrication controller is configured to control a speed difference between the contact side of the at least one strip of the selection and the cylindrical outer surface of the at least one lubrication member by adjusting the rotation direction and/or the rotational speed of the at least one lubrication member.

5. The system according to claim 2, wherein the lubrication controller is configured to maintain the speed difference between the contact side of the at least one strip of the selection and the cylindrical outer surface of the at least one lubrication member at a predetermined speed value in order to maintain the thickness of the applied layer of lubrication material at a predetermined thickness value.

6. The system according to claim 2, wherein the lubrication controller is configured to increase the speed difference between the contact side of the at least one strip of the selection and the cylindrical outer surface of the at least one lubrication member in order to increase the thickness of the applied layer of lubrication material.

7. The system according to claim 2, wherein the lubrication controller is configured to decrease the speed difference between the contact side of the at least one strip of the selection and the cylindrical outer surface of the at least one lubrication member in order to decrease the thickness of the applied layer of lubrication material.

8. The system according to claim 2, wherein:

the lubrication device comprises at least one member surface sensor to measure a member surface characteristic, such as a member surface speed or a member surface radius, of the cylindrical outer surface of the at least one lubrication member and at least one member communication connection connecting the lubrication controller with the at least one member surface sensor, and the lubrication controller is configured to control the rotation direction and/or the rotational speed of the lubrication member on basis of measurements from the at least one member surface sensor.

9. The system according to claim 2, wherein:

the lubrication device comprises at least one strip surface sensor to measure a strip surface speed of the contact side of the at least one strip of the selection and at least one strip communication connection connecting the lubrication controller with the at least one strip surface sensor, and the lubrication controller is configured to control the rotation direction and/or the rotational speed of the lubrication member on basis of measurements from the at least one strip surface sensor.

10. The system according to claim 9, wherein:

the lubrication controller is connected with the winding device, more specifically with a winding drive of the winding device, via a winding communication connection, and the lubrication controller is configured to control a winding speed with which the at least one strip of the selection is wound around the mandrel on basis of measurements from the at least one strip surface sensor.

11. The system according to claim 2, wherein;

the lubrication device comprises at least one strip surface sensor to measure a strip surface speed of the contact side of the at least one strip of the selection and at least one strip communication connection connecting the lubrication controller with the at least one strip surface sensor, the lubrication controller is connected with the winding device, more specifically with a winding drive of the winding device, via a winding communication connection, and the lubrication controller is configured to control a winding speed with which the at least one strip of the selection is wound around the mandrel on basis of measurements from the at least one strip surface sensor.

12. The system according to claim 11, wherein the lubrication controller is configured to control the rotation direction and/or the rotational speed of the lubrication member on basis of measurements from the at least one strip surface sensor.

13. The system according to claim 2, wherein the lubrication controller is configured to rotate the cylindrical outer surface of the at least one lubrication member in an opposite direction as the contact side of the at least one strip of the selection being in contact with the cylindrical outer surface in order to control the thickness of the layer of lubrication material applied to said contact side.

14. The system according to claim 2, wherein the lubrication controller is configured to increase the rotational speed of the cylindrical outer surface of the at least one lubrication member in an opposite direction as the contact side of the at least one strip of the selection being in contact with the cylindrical outer surface in order to increase the thickness of the layer of lubrication material applied to said contact side.

15. The system according to claim 2, wherein the lubrication controller is configured to rotate the cylindrical outer surface of the at least one lubrication member in a same direction as the contact side of the at least one strip of the selectin being in contact with the cylindrical outer surface in order to control the thickness of the layer of lubrication material applied to said contact side.

16. The system according to claim 2, wherein the lubrication controller is configured to increase the rotational speed of the cylindrical outer surface of the at least one lubrication member in a same direction as the contact side of the at least one strip of the selection being in contact with the cylindrical outer surface in order to decrease the thickness of the layer of lubrication material applied to said contact side.

17. The system according to claim 1, wherein the strip supplying device is configured to supply paper strips and the winding device is configured to helically wind the paper strips around the mandrel.

18. The system according to claim 17, wherein the strip supplying device is configured to supply only paper strips.

19. The system according to claim 1, wherein the lubrication material is a solid material.

20. The system according to claim 1, wherein the lubrication material is a wax, such as a paraffin wax.

21. The system according to claim 1, wherein:

the lubrication member has a first strip guide located at a first end of the cylindrical outer surface and a second strip guide located at a second end of the cylindrical outer surface, and the first strip guide and the second strip guide extend radially with respect to the cylinder axis and beyond the cylindrical outer surface.

22. The system according to claim 2, wherein the lubrication controller is connected with the lubrication drive via a lubrication communication connection.

23. A method for producing lengths of tube, such as drinking straws, with a system according to claim 1, said method comprising:

supplying strips with the strip supplying device to the winding device and helically winding said strips around the mandrel to form a base tube moving away from the mandrel at a tube speed, wherein a selection of at least one of the strips during the winding is placed with a contact side thereof in direct contact with the mandrel, cutting the base tube at a predetermined length with the cutting device while the base tube is moving in a tube direction at the tube speed, and moving the at least one strip of the selection along the lubrication device to apply a layer of lubrication material on the contact side of the at least one strip of the selection before said at least one strip of the selection is wound around the mandrel.

24. The method according to claim 23, wherein the method comprises using a lubrication controller to control the rotation direction and/or the rotational speed of the at least one lubrication member driven by the at least one lubrication drive.

25. The method according to claim 23, wherein the method comprises using a lubrication controller to adjust a thickness of the layer of lubrication material applied to the contact side of the at least one strip of the selection by adjusting the rotation direction and/or the rotational speed of the at least one lubrication member.

* * * * *